US007206536B2

(12) United States Patent
Julien

(10) Patent No.: US 7,206,536 B2
(45) Date of Patent: Apr. 17, 2007

(54) PRINTING SYSTEM WITH CUSTOM MARKING MODULE AND METHOD OF PRINTING

(75) Inventor: Paul C. Julien, Webster, NY (US)

(73) Assignee: Xerox Corporation, Stamford, CT (US)

( * ) Notice: Subject to any disclaimer, the term of this patent is extended or adjusted under 35 U.S.C. 154(b) by 117 days.

(21) Appl. No.: 11/093,229

(22) Filed: Mar. 29, 2005

(65) Prior Publication Data

US 2006/0222378 A1 Oct. 5, 2006

(51) Int. Cl.
*G03G 15/00* (2006.01)

(52) U.S. Cl. ..... 399/110

(58) Field of Classification Search ..... 399/2, 399/107, 110

See application file for complete search history.

(56) References Cited

U.S. PATENT DOCUMENTS 4,579,446 A 4/1986 Fujino et al.
4,587,532 A 5/1986 Asano
4,836,119 A 6/1989 Siraco
5,080,340 A 1/1992 Hacknauer
5,095,342 A 3/1992 Farrell et al.
5,159,395 A 10/1992 Farrell et al.
5,208,640 A 5/1993 Horie
5,272,511 A 12/1993 Conrad
5,326,093 A 7/1994 Sollitt
5,389,969 A 2/1995 Suzuki
5,435,544 A 7/1995 Mandel
5,473,419 A 12/1995 Russel
5,489,969 A 2/1996 Soler et al.
5,504,568 A 4/1996 Saraswat
5,525,031 A 6/1996 Fox
5,557,367 A 9/1996 Yang et al.
5,568,246 A 10/1996 Keller et al.
5,570,172 A 10/1996 Acquaviva
5,570,451 A * 10/1996 Sakaizawa et al. ..... 399/2
5,596,416 A 1/1997 Barry et al.
5,629,762 A 5/1997 Mahoney
5,710,968 A 1/1998 Clark
5,778,377 A 7/1998 Marlin
5,884,910 A 3/1999 Mandel
5,953,559 A * 9/1999 Obu ..... 399/110
5,995,721 A 11/1999 Rourke et al.
6,059,284 A 5/2000 Wolf (Continued)

OTHER PUBLICATIONS

Morgan, P.F., "Integration of Black Only and Color Printers", Xerox Disclosure Journal, vol. 16, No. 6, Nov./Dec. 1991, pp. 381-383.

(Continued)

*Primary Examiner*—Sandra L. Brase
(74) *Attorney, Agent, or Firm*—Eugene O. Palazzo; Fay Sharpe LLP

(57) ABSTRACT

A xerographic printing system includes a group of marking modules which apply a marking medium to print media, at least one of the marking modules being a custom marking module. A control system is configured for being operatively linked with marking modules. The printing system has a first mode of operation in which a first plurality of the group of marking modules is operatively linked to the control system and a second mode of operation in which a second plurality of the marking modules is operatively linked to the control system, the second plurality of marking modules including the at least one custom marking module.

18 Claims, 5 Drawing Sheets

U.S. PATENT DOCUMENTS

| | | | | |
|---|---|---|---|---|
| 6,097,500 | A | 8/2000 | Fromherz | |
| 6,125,248 | A | 9/2000 | Moser | |
| 6,188,861 | B1 * | 2/2001 | Parker et al. | 399/299 |
| 6,241,242 | B1 | 6/2001 | Munro | |
| 6,297,886 | B1 | 10/2001 | Cornell | |
| 6,384,918 | B1 | 5/2002 | Hubble, III | |
| 6,393,245 | B1 * | 5/2002 | Jia et al. | 399/307 |
| 6,450,711 | B1 | 9/2002 | Conrow | |
| 6,476,376 | B1 | 11/2002 | Biegelsen | |
| 6,476,923 | B1 | 11/2002 | Cornell | |
| 6,493,098 | B1 | 12/2002 | Cornell | |
| 6,537,910 | B1 | 3/2003 | Burke | |
| 6,550,762 | B2 | 4/2003 | Stoll | |
| 6,554,276 | B2 | 4/2003 | Jackson et al. | |
| 6,577,925 | B1 | 6/2003 | Fromherz | |
| 6,607,320 | B2 | 8/2003 | Bobrow et al. | |
| 6,608,988 | B2 | 8/2003 | Conrow | |
| 6,612,566 | B2 | 9/2003 | Stoll | |
| 6,618,167 | B1 | 9/2003 | Shah | |
| 6,621,576 | B2 | 9/2003 | Tandon | |
| 6,633,382 | B2 | 10/2003 | Hubble, III | |
| 6,639,669 | B2 | 10/2003 | Hubble, III | |
| 6,654,136 | B2 | 11/2003 | Shimada | |
| 6,819,906 | B1 | 11/2004 | Herrmann | |
| 7,010,242 | B2 * | 3/2006 | Suzuki et al. | 399/110 |
| 2002/0078012 | A1 | 6/2002 | Ryan | |
| 2002/0103559 | A1 | 8/2002 | Gartstein | |
| 2003/0077095 | A1 | 4/2003 | Conrow | |
| 2004/0085561 | A1 | 5/2004 | Fromherz | |
| 2004/0085562 | A1 | 5/2004 | Fromherz | |
| 2004/0088207 | A1 | 5/2004 | Fromherz | |
| 2004/0150156 | A1 | 8/2004 | Fromherz | |
| 2004/0150158 | A1 | 8/2004 | Biegelsen | |
| 2004/0153983 | A1 | 8/2004 | McMillan | |
| 2004/0216002 | A1 | 10/2004 | Fromherz | |
| 2004/0225391 | A1 | 11/2004 | Fromherz | |
| 2004/0225394 | A1 | 11/2004 | Fromherz | |
| 2006/0039728 | A1 * | 2/2006 | deJong et al. | 399/381 |
| 2006/0115288 | A1 * | 6/2006 | Roof | 399/67 |
| 2006/0115306 | A1 * | 6/2006 | Lofthus et al. | 399/341 |
| 2006/0197966 | A1 * | 9/2006 | Viturro et al. | 358/1.9 |

OTHER PUBLICATIONS

Desmond Fretz, "Cluster Printing Solution Announced", Today at Xerox (TAX), No. 1129, Aug. 3, 2001.

U.S. Appl. No. 60/478,749, entitled "Universal Flexible Plural Pinter to Plural Finisher Sheet Integration System".

U.S. Appl. No. 10/761,522, entitled "High Print Rate Merging and Finishing System for Parallel Printing".

* cited by examiner

PRINTING SYSTEM WITH CUSTOM MARKING MODULE AND METHOD OF PRINTING

CROSS REFERENCE TO RELATED APPLICATIONS

The following applications, the disclosures of each being totally incorporated herein by reference are mentioned:

- U.S. Provisional Application Ser. No. 60/631,651, filed Nov. 30, 2004, entitled "TIGHTLY INTEGRATED PARALLEL PRINTING ARCHITECTURE MAKING USE OF COMBINED COLOR AND MONOCHROME ENGINES," by David G. Anderson, et al.;
- U.S. Provisional Application Ser. No. 60/631,656, filed Nov. 30, 2004, entitled "MULTI-PURPOSE MEDIA TRANSPORT HAVING INTEGRAL IMAGE QUALITY SENSING CAPABILITY," by Steven R. Moore;
- U.S. Provisional Patent Application Ser. No. 60/631,918, filed Nov. 30, 2004, entitled "PRINTING SYSTEM WITH MULTIPLE OPERATIONS FOR FINAL APPEARANCE AND PERMANENCE," by David G. Anderson et al.;
- U.S. Provisional Patent Application Ser. No. 60/631,921, filed Nov. 30, 2004, entitled "PRINTING SYSTEM WITH MULTIPLE OPERATIONS FOR FINAL APPEARANCE AND PERMANENCE," by David G. Anderson et al.;
- U.S. application Ser. No. 10/761,522, filed Jan. 21, 2004, entitled "HIGH RATE PRINT MERGING AND FINISHING SYSTEM FOR PARALLEL PRINTING," by Barry P. Mandel, et al.;
- U.S. application Ser. No. 10/785,211, filed Feb. 24, 2004, entitled "UNIVERSAL FLEXIBLE PLURAL PRINTER TO PLURAL FINISHER SHEET INTEGRATION SYSTEM," by Robert M. Lofthus, et al.;
- U.S. application Ser. No. 10/860,195, filed Aug. 23, 2004, entitled "UNIVERSAL FLEXIBLE PLURAL PRINTER TO PLURAL FINISHER SHEET INTEGRATION SYSTEM," by Robert M. Lofthus, et al.;
- U.S. application Ser. No. 10/881,619, filed Jun. 30, 2004, entitled "FLEXIBLE PAPER PATH USING MULTIDIRECTIONAL PATH MODULES," by Daniel G. Bobrow.;
- U.S. application Ser. No. 10/917,676, filed Aug. 13, 2004, entitled "MULTIPLE OBJECT SOURCES CONTROLLED AND/OR SELECTED BASED ON A COMMON SENSOR," by Robert M. Lofthus, et al.;
- U.S. application Ser. No. 10/917,768, filed Aug. 13, 2004, entitled "PARALLEL PRINTING ARCHITECTURE CONSISTING OF CONTAINERIZED IMAGE MARKING ENGINES AND MEDIA FEEDER MODULES," by Robert M. Lofthus, et al.;
- U.S. application Ser. No. 10/924,106, filed Aug. 23, 2004, for PRINTING SYSTEM WITH HORIZONTAL HIGHWAY AND SINGLE PASS DUPLEX by Lofthus, et al.;
- U.S. application Ser. No. 10/924,113, filed Aug. 23, 2004, entitled "PRINTING SYSTEM WITH INVERTER DISPOSED FOR MEDIA VELOCITY BUFFERING AND REGISTRATION," by Joannes N. M. dejong, et al.;
- U.S. application Ser. No. 10/924,458, filed Aug. 23, 2004 for PRINT SEQUENCE SCHEDULING FOR RELIABILITY by Robert M. Lofthus, et al.;
- U.S. patent application Ser. No. 10/924,459, filed Aug. 23, 2004, entitled "PARALLEL PRINTING ARCHITECTURE USING IMAGE MARKING DEVICE MODULES," by Barry P. Mandel, et al;
- U.S. patent application Ser. No. 10/953,953, filed Sep. 29, 2004, entitled "CUSTOMIZED SET POINT CONTROL FOR OUTPUT STABILITY IN A TIPP ARCHITECTURE," by Charles A. Radulski et al.;
- U.S. application Ser. No. 10/999,326, filed Nov. 30, 2004, entitled "SEMI-AUTOMATIC IMAGE QUALITY ADJUSTMENT FOR MULTIPLE MARKING ENGINE SYSTEMS," by Robert E. Grace, et al.;
- U.S. patent application Ser. No. 10/999,450, filed Nov. 30, 2004, entitled "ADDRESSABLE FUSING FOR AN INTEGRATED PRINTING SYSTEM," by Robert M. Lofthus, et al.;
- U.S. patent application Ser. No. 11/000,158, filed Nov. 30, 2004, entitled "GLOSSING SYSTEM FOR USE IN A TIPP ARCHITECTURE," by Bryan J. Roof;
- U.S. patent application Ser. No. 11/000,168, filed Nov. 30, 2004, entitled "ADDRESSABLE FUSING AND HEATING METHODS AND APPARATUS," by David K. Biegelsen, et al.;
- U.S. patent application Ser. No. 11/000,258, filed Nov. 30, 2004, entitled "GLOSSING SYSTEM FOR USE IN A TIPP ARCHITECTURE," by Bryan J. Roof;
- U.S. application Ser. No. 11/001,890, filed Dec. 2, 2004, entitled "HIGH RATE PRINT MERGING AND FINISHING SYSTEM FOR PARALLEL PRINTING," by Robert M. Lofthus, et al.;
- U.S. application Ser. No. 11/002,528, filed Dec. 2, 2004, entitled "HIGH RATE PRINT MERGING AND FINISHING SYSTEM FOR PARALLEL PRINTING," by Robert M. Lofthus, et al.;
- U.S. application Ser. No. 11/051,817, filed Feb. 4, 2005, entitled "PRINTING SYSTEMS," by Steven R. Moore, et al.;
- U.S. application Ser. No. 11/069,020, filed Feb. 28, 2004, entitled "PRINTING SYSTEMS," by Robert M. Lofthus, et al.;
- U.S. application Ser. No. 11/070,681, filed Mar. 2, 2005, entitled "GRAY BALANCE FOR A PRINTING SYSTEM OF MULTIPLE MARKING ENGINES," by R. Enrique Viturro, et al.; and,
- U.S. application Ser. No. 11/081,473, filed Mar. 16, 2005, entitled "MULTI-PURPOSE MEDIA TRANSPORT HAVING INTEGRAL IMAGE QUALITY SENSING CAPABILITY," by Steven R. Moore.

BACKGROUND

The present exemplary embodiment relates generally to a printing system comprising at least two marking engines and more particularly to a modular printing system in which a custom color marking engine module can be temporarily substituted for an existing marking engine module for custom color printing by the system.

Lithographic printing processes typically have a separate marking station for applying inks in each of the four primary colors: cyan, magenta, yellow and black (CMYK). By laying down combinations of these colored inks on print media, different colors and tones are achieved. Where accurate color rendition is required, one or more additional marking stations are added in the process line for custom color inks. The print media to be printed passes through each of these marking stations.

In a typical xerographic marking engine, such as a copier or printer, a photoconductive insulating member is charged to a uniform potential and thereafter exposed to a light image of an original document to be reproduced. The exposure discharges the photoconductive insulating surface in exposed or background areas and creates an electrostatic latent image on the member, which corresponds to the image areas contained within the document. Subsequently, the electrostatic latent image on the photoconductive insulating surface is made visible by developing the image with a developing material. Generally, the developing material comprises toner particles adhering triboelectrically to carrier granules. The developed image is subsequently transferred to a print medium, such as a sheet of paper. The fusing of the toner onto paper is generally accomplished by applying heat to the toner with a heated roller and application of pressure. In multi-color printing, successive latent images corresponding to different colors are recorded on the photoconductive surface and developed with toner of a complementary color. The single color toner images are successively transferred to the copy paper to create a multi-layered toner image on the paper. The multi-layered toner image is permanently affixed to the copy paper in the fusing process.

Xerographic printers do not have the facility to add an extra marking station for custom color in the way that lithographic machines do since the color stations are in fixed locations around a photoreceptor of limited length. Where a custom color is to be applied, this is often achieved in a separate lithography process, prior to xerographic printing with the four primary colors. As a result, a xerographic printer may need to have on hand a variety of preprinted paper stocks which are fed to the xerographic printer when a particular customer's order is to be printed.

REFERENCES

The following references, the disclosures of which are incorporated herein by reference in their entireties, variously relate to "tandem engine" printers, "parallel" printers, "cluster printing", and "output merger" or "interposer" systems: U.S. Pat. No. 5,568,246 to Keller, et al., U.S. Pat. No. 4,587,532 to Asano, U.S. Pat. No. 5,570,172 to Acquaviva, U.S. Pat. No. 5,596,416 to Barry, et al.; U.S. Pat. No. 5,995,721 to Rourke et al; U.S. Pat. No. 4,579,446 to Fujino; U.S. Pat. No. 5,389,969 to to Soler, et al.; a 1991 "Xerox Disclosure Journal" publication of November–December. 1991, Vol. 16, No. 6, pp. 381–383 by Paul F. Morgan; and a Xerox Aug. 3, 2001 "TAX" publication product announcement entitled "Cluster Printing Solution Announced."

BRIEF DESCRIPTION

Aspects of the disclosure, in embodiments herein, relate to a printing system and method. The printing system may include a group of marking modules which apply a marking medium to print media, at least one of the marking modules being a custom marking module. A control system is configured for being operatively linked with marking modules for printing images on the linked marking modules from a common print job stream. The printing system has a first mode of operation in which a first plurality of the group of marking modules is operatively linked to the control system and also linked to a common output destination and a second mode of operation in which a second plurality of the marking modules is operatively linked to the control system and to the common output destination, the second plurality of marking modules including the at least one custom marking module.

A xerographic printing method includes printing print media in a first print job with a printing system comprising a plurality of marking modules which are operatively connected for printing from a common job stream. A custom marking module is added to the printing system such that the custom marking module is operatively connected to at least one of the plurality of marking modules for printing from a common job stream. In a second print job, print media is printed with the printing system comprising the custom marking module.

In another aspect, a system includes a group of marking modules, each of the marking modules being capable of applying marking media to print media and fusing the marking media to the print media. A print media network selectively connects a plurality of the marking modules selected from the group of marking modules with a common output destination whereby the plurality of the marking modules are operatively connected for printing from a common job stream, at least one of the marking modules being interchangeable with another of the marking modules. A control system controls the marking modules that are operatively connected.

DETAILED DESCRIPTION

Aspects of the embodiments disclosed herein relate to a xerographic printing system which facilitates custom color printing as well as printing with primary colors (CMYK). The printing system includes a plurality of image marking engines, which may be linked by a common network of pathways which connects the marking engines with each other and with an output destination. The marking engines may all be under the control of a common control system for printing images from a common print job stream. The printing system can have a modular architecture which allows one or more marking modules to be interchanged with other marking modules. The system enables custom color, and process color and/or black and white printing on the same sheet in a single printing system.

The term "marking engine" is used herein generally to refer to a device for applying an image to print media. Print media generally refers to a usually flimsy physical sheet of paper, plastic, or other suitable physical print media substrate for images, whether precut or web fed.

Figure 1:
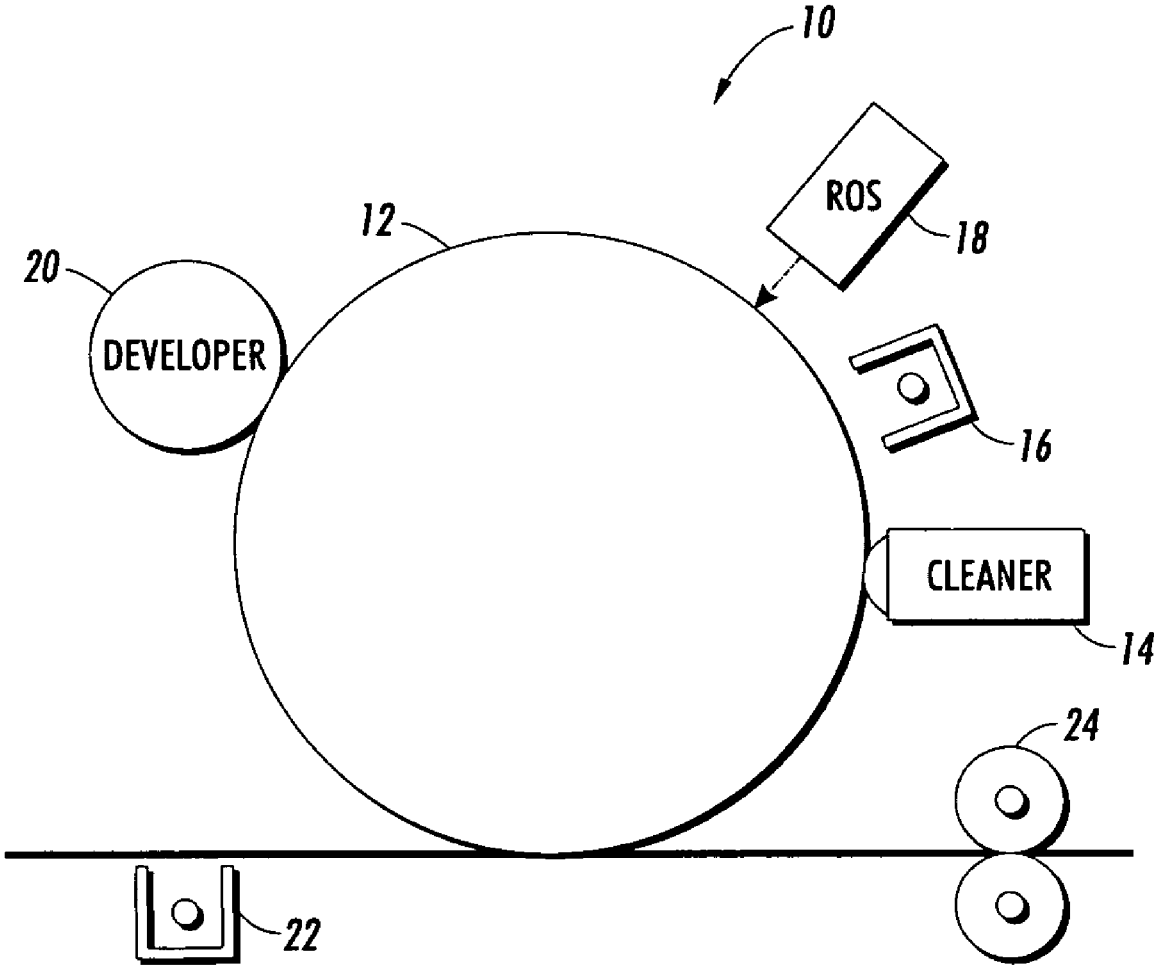
FIG. 1 is a schematic view of a xerographic marking engine.

As illustrated in FIG. 1, a marking engine 10 serves as a replaceable xerographic module in the printing system. The marking engine 10 includes many of the hardware elements employed in the creation of desired images by electrophotographical processes. In the case of a xerographic device, the marking engine typically includes a charge retentive surface, such as a rotating photoreceptor 12 in the form of a belt or drum. The images are created on a surface of the photoreceptor. Disposed at various points around the circumference of the photoreceptor 12 are xerographic subsystems which include a cleaning device generally indicated as 14, a charging station for each of the colors to be applied (one in the case of a monochrome printer, four in the case of a CMYK printer), such as a charging corotron 16, an exposure station 18, which forms a latent image on the photoreceptor, a developer unit 20, associated with each charging station for developing the latent image formed on the surface of the photoreceptor by applying a toner to obtain a toner image, a transferring unit, such as a transfer corotron 22 transfers the toner image thus formed to the surface of a print media substrate, such as a sheet of paper, and a fuser 24, which fuses the image to the sheet. The fuser generally applies at least one of heat and pressure to the sheet to physically attach the toner and optionally to provide a level of gloss to the printed media.

While particular reference is made to electrophotographic printers, suitable marking engines may also include ink-jet printers, including solid ink printers, thermal head printers that are used in conjunction with heat sensitive paper, and other devices capable of marking an image on a substrate. It is to be appreciated that each of the marking engines can include an input/output interface, a memory, a marking cartridge platform, a marking driver, a function switch, a controller and a self-diagnostic unit, all of which can be interconnected by a data/control bus. Each of the marking engines can have a different processing speed capability.

Figure 2:
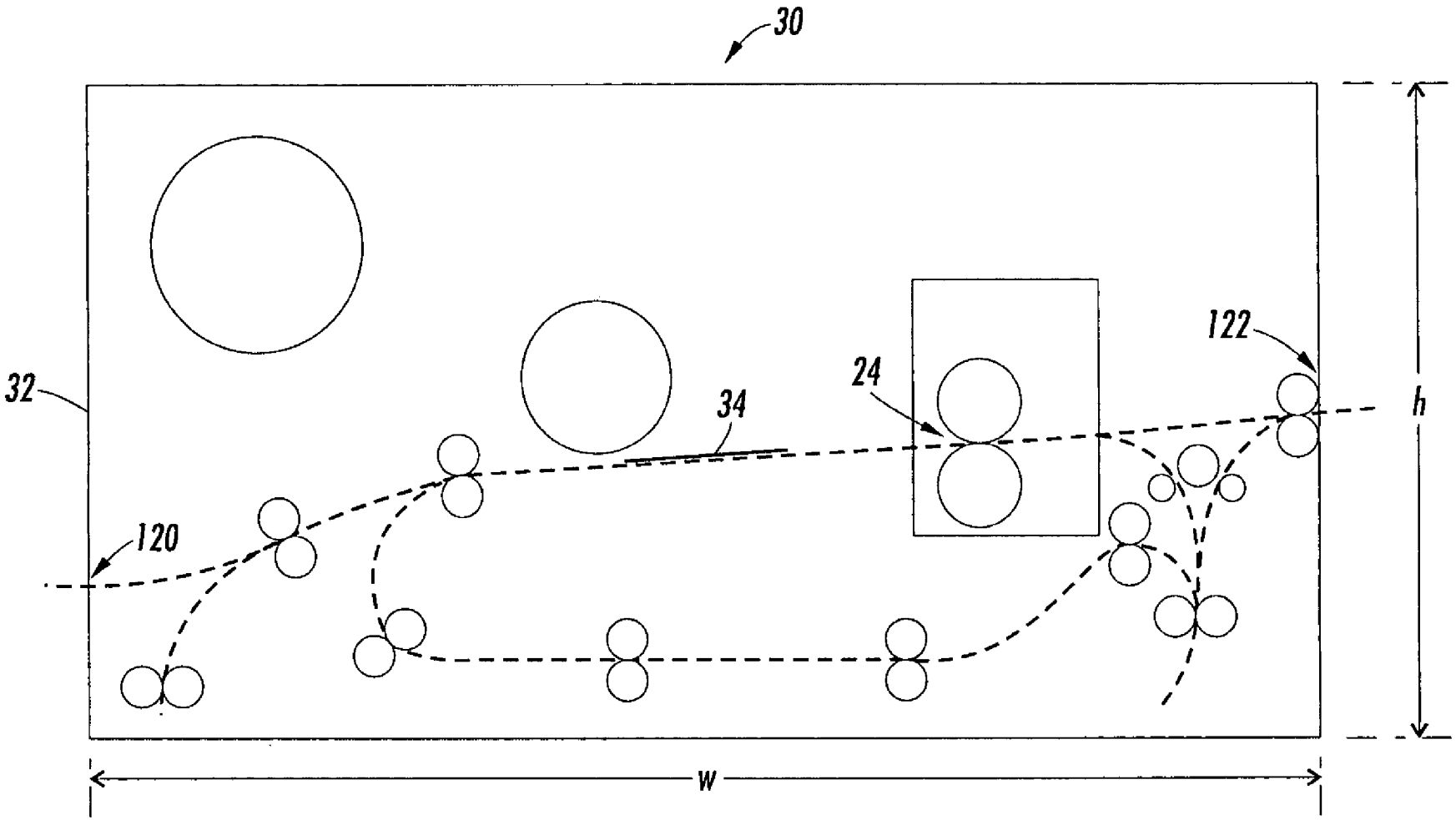
FIG. 2 is a schematic side view of an exemplary marking module.

With reference to FIG. 2, a marking module 30 includes some or all of the components of the marking engine 10 which are thus removable as a unit from the printing system. The marking module includes a housing 32 which may carry the image applying the components of the marking engine (photoreceptor, charging and transfer corotrons, exposure station, and developer unit, which for convenience are shown only schematically) as well as a fuser 24 on or within the housing 32. Alternatively, the marking module may include fewer components. In one embodiment, the marking module includes at least the components for applying a marking medium to print media 34.

Figure 3:
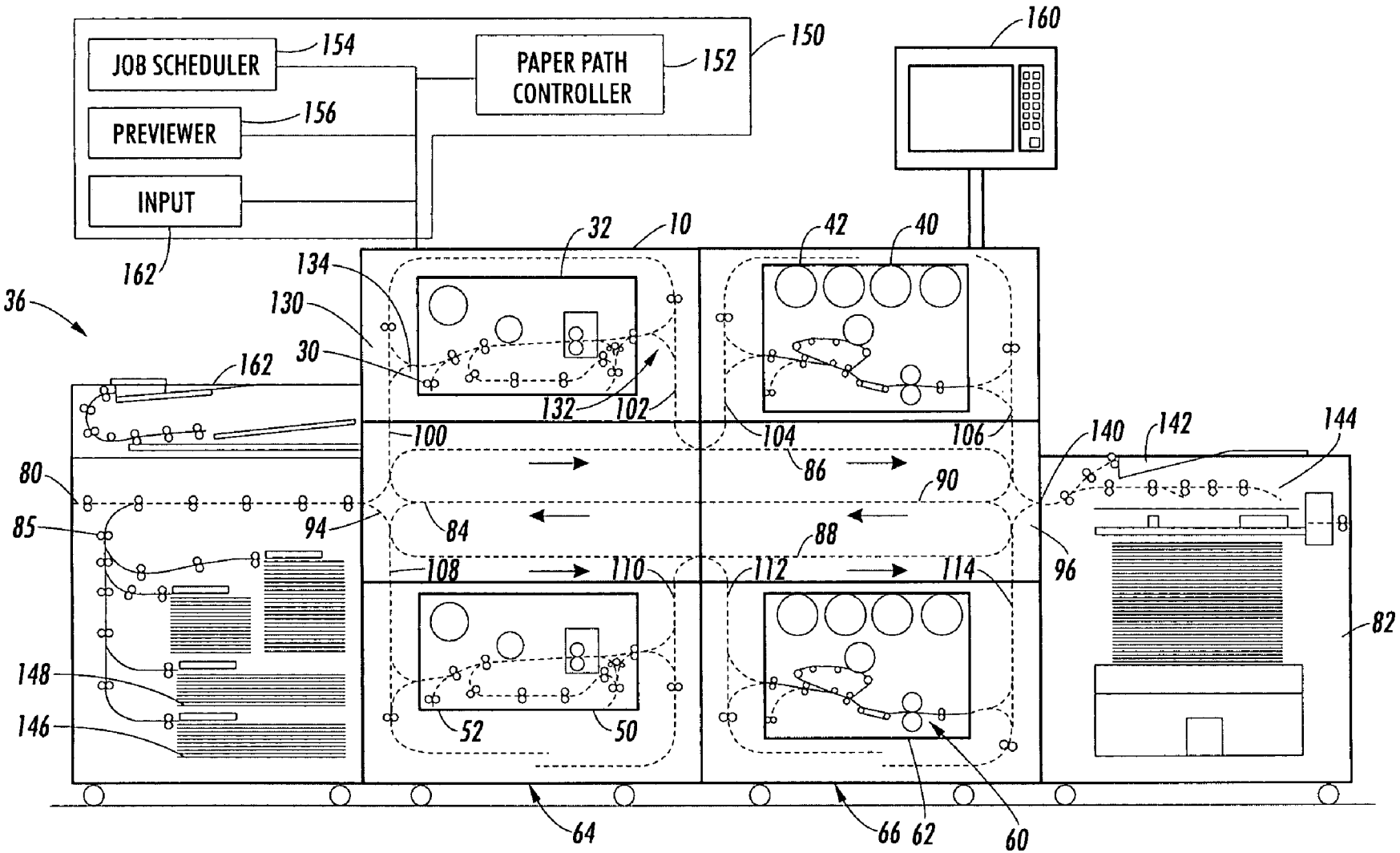
FIG. 3 is a schematic view of a printing system according to one embodiment.

With reference to FIG. 3, an exemplary printing system 36 which incorporates a plurality of replaceable marking modules similar to that shown in FIG. 2 is illustrated. While FIG. 3 illustrates a combination digital copier/printer, the printing system 36 may alternatively be a copier or printer that outputs prints in whatever manner, such as a digital printer, facsimile, or multifunction device, and can create images electrostatographically, by ink-jet, hot-melt, or by any other method. The marking media used by the marking engine can include toner particles, solid or liquid inks, or the like.

The printing system may incorporate "tandem engine" printers, "parallel" printers, "cluster printing," "output merger," or "interposer" systems, and the like, as disclosed, for example, in U.S. Pat. No. 4,579,446 to Fujino; U.S. Pat. No. 4,587,532 to Asano; U.S. Pat. No. 5,489,969 to Soler, et al.; U.S. Pat. No. 5,568,246 to Keller, et al.; U.S. Pat. No. 5,570,172 to Acquaviva; U.S. Pat. No. 5,596,416 to Barry, et al.; U.S. Pat. No. 5,995,721 to Rourke et al; U.S. Pat. No. 6,554,276 to Jackson, et al.; U.S. Pat. No. 6,607,320 to Bobrow, et al., U.S. Pat. No. 6,654,136 to Shimada; and above-mentioned application Ser. Nos. 10/924,459 and 10/917,768, the disclosures of all of these references being incorporated herein by reference. A parallel printing system is one in which two or more printers are configured for contemporaneously printing portions of a single print job and may employ a single paper source which feeds paper from a common paper stream to a plurality of printers or multiple paper sources. The printers may be horizontally and/or vertically stacked. Printed media from the various printers is then taken from the printer to a common output destination. The common output destination can be a finisher, where the sheets associated with a single print job are assembled, or other location which is accessible from all of the printers for receiving printed media. Variable vertical level, rather than horizontal, input and output sheet path interface connections may be employed, as disclosed, for example, in U.S. Pat. No. 5,326,093 to Sollitt.

A "print job" is normally a set of related sheets, usually one or more collated copy sets copied from a set of original document sheets or electronic document page images, from a particular user, or which are otherwise related.

In one operational mode, which may be referred to a normal printing, the printing system 36 includes one or more primary marking modules 30, 40, 50, 60 configured for process color printing, such as CMY and CMYK, black only (K), or a combination of these. For example, the printing system may include one or more process color marking modules 40, 60 and/or one or more black only (K) marking modules 30, 50. Each of these "primary" marking modules 30, 40, 50, 60 includes a housing 32, 42, 52, 62, respectively, supporting some or all of the components of the marking engine. In the embodiment illustrated in FIG. 3, a printing system is illustrated, by way of example, with two process color marking modules 30, 40, and two black only marking modules 50, 60, each with its own marking module housing 32, 42, 52, 62. Two towers 64, 66 provide a support structure for receiving the modules and remain in the system when one or more of the modules is removed. In the illustrated embodiment, the support structure allows printing to be performed on remaining marking modules even when one or more of the modules is removed. While the illustrated embodiment shows the marking modules stacked in two towers 64, 66, it is also contemplated that the modules may be otherwise arranged, such as horizontally aligned, optionally, in or on a support structure.

Figure 4:
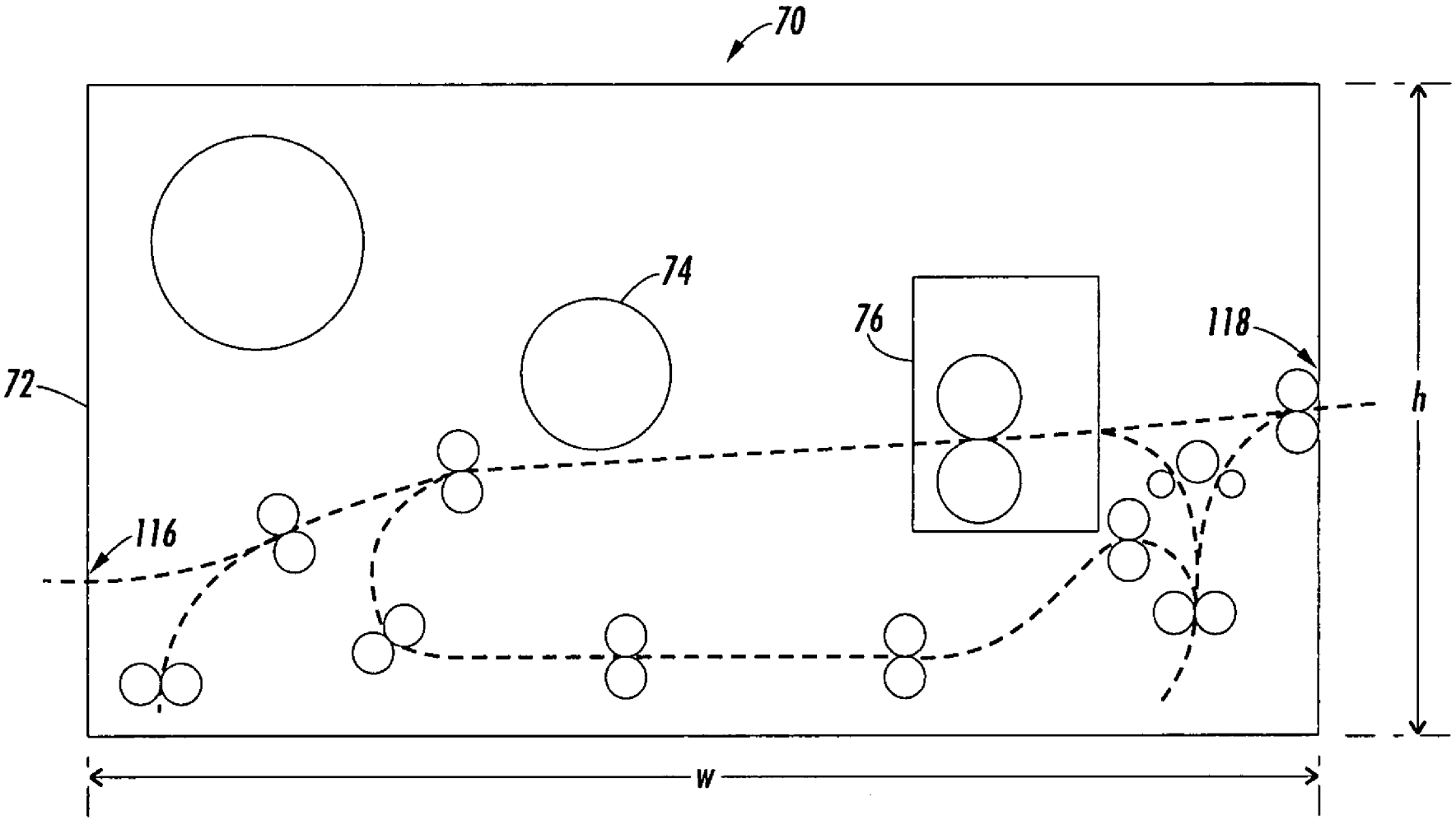
FIG. 4 is a schematic side view of an exemplary custom color marking module.

In a second operating mode, which may be referred to as custom printing, one or more of the primary marking modules 30, 40, 50, 60 is replaced with another marking module configured for custom printing—a "custom" marking module 70 (FIG. 4). Like the primary marking modules used for normal printing, the custom marking module 70 includes a housing 72 which carries components of the marking engine. In place of CMY and/or K components, however, the custom marking module includes at least one custom color image apply component 74, and optionally a fuser 76. By way of example, FIG. 3 shows a custom marking module 70 for a single custom color, although it will be appreciated that more than one custom color station may be provided, such as two, three or four custom color image applying components in a single custom marking module.

The primary modules 30, 40, 50, 60 are generally those which can perform most or all of the ordinary print jobs that the printing system is expected to accommodate. The custom modules 70 are generally used for adding functionality to the system which is required for less frequent print jobs, particularly those which include custom color printing on at least a portion of the sheets in the print job.

In one embodiment, any one or more of the primary marking modules 30, 40, 50, 60 is replaced with a custom marking module in the second operating mode. Typically, at least one of the primary marking modules 30, 40, 50, 60 is retained in the printing system such that the printing system is capable of both custom printing and primary printing in a single printing operation.

Whereas process color marking engines achieve different colors by combinations of the three primary colors CMY and optionally also black K, typically in the form of different color toners which are superimposed on one another, the custom color marking engines are fed with a premixed ink or toner, which provides a specific color, generally with a higher color rendering accuracy than can be achieved with a process color marking engine. The custom color marking engine formed when the module 70 is installed in the Printing System can thus be a monochrome marking engine similar to a black engine, but which provides a color other than black. Custom colors can be used as highlights and are particularly suited for applying portions of a document which are required to be of a highly consistent and reproducible color, such as trademark designs, company logos, and the like. Custom color (C) here is used interchangeably with other terms in the trade, such as signature color, highlight color, or Pantone™ color. For purposes of the present exemplary embodiment, the custom marking engine may additionally or alternatively be used for applying marking media for magnetic ink character recognition (MICR) and clearcoat printing. MICR printing applies a magnetic pattern or other detectable portion to the page, for example, as a security feature for bank notes. Clear coat printing applies a transparent overcoat to a printed sheet to protect other color layers from abrasion.

The custom marking module housing 72 is of the same general size and shape as that of the primary marking module or modules which it replaces so that it is able to fit into the space occupied by the primary marking module. In the illustrated embodiment, the process color marking modules 40, 60 are larger than the black modules 30, 50. A custom color module 70 with a single or multiple marking stations may be similarly sized to either the black marking modules or the process color modules, depending on the functionality desired for the printing system when the custom module 70 is in use. For increased flexibility, the housings of all the marking modules 30, 40, 50, 60, 70 may be of the same size, allowing any module to be replaced with any other module. In one embodiment, the custom module has the same footprint as the module which it replaces (same height h and width w). In another embodiment, the custom module and primary module are the same or approximately the same in all three dimensions.

When one of the modules 30, 40, 50, 60, is replaced by a custom color marking module 70, the printing system may still be able to provide the functions of the removed marking engine module using one of the remaining marking modules. For example, if black module 30 is replaced by the custom module 70, the printing system is still capable of black printing, either with the remaining black module(s) or, in the illustrated embodiment, with one of the two CMYK process color modules 40, 60.

The operational marking engine modules 30, 40, 50, 60, 70 that are in the printing system at any particular time are connected with each other and with a feeder module 80 and a finishing module 82 by a print media transport system 84 including a network of paper pathways. In its simplest form, the network 84 enables the printed media outputs of two or more marking engines to be combined as a common stream so that they can be assembled, for example at the finisher 82, into the same document. In the illustrated embodiment, the network 84 enables print media to travel from the feeder module 80 to any one of the marking engines and between any marking engine and any other marking engine in the system, although more limited pathways may be provided, depending on the requirements of the system. Additionally, the network 84 enables print media to be printed by two or more of the marking engines contemporaneously. For example, process color (P) printing can be performed by marking engine module 40 on a portion of a print job, while at the same time, process color printing is performed by marking engine module 60 on another portion of the print job and/or black printing by one of the black marking modules 30, 50. Print media from each of these marking modules can be assembled into the same document at the finisher 82.

The paper pathway network 84 includes a plurality of drive elements 85, illustrated as pairs of rollers, although other drive elements, such as airjets, spherical balls, belts, and the like are also contemplated. The paper pathway network 84 may include at least one downstream print media highway 86, 88 (two in the illustrated embodiment), and at least one upstream print media highway 90, along which the print media is conveyed in a generally opposite direction to the downstream highways 86, 88. The highways 86, 88, 90 are arranged generally horizontally, and in parallel in the illustrated embodiment, although it is also contemplated that portions of these highways may travel in other directions, including vertically. The main highways 86, 88, 90 are connected at ends thereof with each other, and with the feeder module 80 and finisher module 82, by cloverleaf connection pathways 94, 96.

Pathways 100, 102, 104, 106, 108, 110, 112, 114, etc. feed the print media between the highways 86, 88, 90 and the marking engines 30, 40, 50, 60 and 70 (where present). As will be appreciated, each of the marking modules includes paper pathways which are removed when the marking module is removed from the printing system. Accordingly, the replacement custom marking module 70 (FIG. 4) has inlet and outlet connections 116, 118 which are at the same height and location as the inlet and outlet pathways 120, 122 (FIG. 2) of the marking module 30 which it replaces. The highways 86, 88, 90 and/or pathways 100, 102, 104, 106, 108, 110, 112, 114 may include inverters, reverters, interposers, bypass pathways, and the like as known in the art to direct the print media between the highway and a selected marking engine or between two marking engines. For example, as shown in FIG. 3, each marking engine has an input side inverter 130 and an output side inverter 132 connected with the respective input and output pathways. The network 84 is structured such that one or both the inverters 130, 132 can be bypassed, in the illustrated embodiment, by incorporation of bypass pathways 134 on the input and/or output sides respectively. Additionally, any one of the inverter assemblies shown could also be used to register the sheet in skew or in a lateral direction.

Print media from the various marking engines and highways is collected as a common stream and delivered by an exit pathway 140 to the finisher module 82. The finisher module may include one or a plurality of output destinations, herein illustrated as output trays 142, 144. The finisher can include any post-printing accessory device such as one or more of a sorter, mailbox, inserter, interposer, folder, stapler, stacker, hole puncher, collater, stitcher, binder, envelope stuffer, postage machine, or the like.

The feeder module 80 may include one or more print media sources, such as paper trays 146, 148, etc. While in the illustrated embodiment, all of the marking engines 30, 40, 50, 60, and/or 70 (where present) are fed from a common high speed feeder module 80, it is also contemplated that the marking engines may be associated separate print media feeders. An exemplary feeder is described for example, in above-mentioned application Ser. No. 10/917,768, incorporated herein by reference. In addition to the modules described herein, the printing system 36 may include additional modules, such as modules for collection of waste media and modules which apply a post printing treatment to the imaged print media, and the like.

The printing system includes a control system 150, such as a network print server, which controls the operation of the printing system 36 and communicates with the individual marking engines 30 via wired or wireless links. The control system may be centrally located or distributed. The control system includes a paper path controller 152 which controls the movement of sheets through the printing system along the various pathways. Paper path controller 152 is responsive to a scheduling system 154 which schedules the routing of the sheets to and from marking engines 30, 40, 50, 60, and/or 70 (where present) by utilizing pathways of the network 84. The sheets may be routed to two or more marking engines, for example, to provide single pass duplex printing (each of two marking engines prints one side of a sheet) or to provide composite images (multiple images on the same side of a sheet).

In turn, the scheduling system 154 receives information about the document to be printed from a previewer 156, which may located along with the scheduling system 154 and paper path controller 152 within the overall control system 150 for the printing system or elsewhere, such as in the network server or in individual workstations linked thereto. Various methods of scheduling print media sheets may be employed. For example, U.S. Pat. No. 5,095,342 to Farrell, et al.; U.S. Pat. No. 5,159,395 to Farrell, et al.; U.S. Pat. No. 5,557,367 to Yang, et al.; U.S. Pat. No. 6,097,500 to Fromherz; and U.S. Pat. No. 6,618,167 to Shah; and as described, for example, in U.S. application Ser. No. 10/284,560, filed Oct. 30, 2002, for PLANNING AND SCHEDULING RECONFIGURABLE SYSTEMS WITH REGULAR AND DIAGNOSTIC JOBS, by Fromherz; U.S. application Ser. No. 10/284,561, filed Oct. 30, 2002, for PLANNING AND SCHEDULING RECONFIGURABLE SYSTEMS WITH ALTERNATIVE CAPABILITIES by Fromherz; U.S. application Ser. No. 10/424,322, filed Apr. 28, 2003, for MONITORING AND REPORTING INCREMENTAL JOB STATUS SYSTEM AND METHOD by Fromherz, and copending application Ser. No. 10/924,458, filed Aug. 23, 2004, entitled PRINT SEQUENCE SCHEDULING FOR RELIABILITY, all of which are incorporated herein in their entireties by reference, disclose exemplary job scheduling systems which can be used to schedule the print sequence herein, with suitable modifications, such as to include scheduling of the routing of print media to interchangeable marking modules.

In particular, the scheduling system 154, through interrogation of the marking modules in the printing system is capable of identifying the capabilities of the printing system. Thus if a job requiring a particular custom color is received, the scheduler identifies whether there is a marking engine in the system capable of printing the custom color and, if so, the scheduler schedules the custom color portions on that marking engine. If there is no custom color marking engine available in the system, the scheduler/control system alerts a user that the appropriate custom color module needs to be inserted and may indicate which of the alternative principal modules to replace, to best provide the functionalities desired for printing the job. The user then replaces the module and may indicate the completion of the replacement and/or the custom color which had been added by an input function such as through a keyboard or touch screen 160. Alternatively, the control system recognizes the presence of the replacement module through interrogation of the module and takes the appropriate steps for printing the jobs. If the custom color module is not available, the user may instruct the controller to print the custom color portions using a process color module.

If registration is of particular concern, the control system may determine that some parts of an image specified as custom color are better performed by a process color marking engine, for example, if the custom color portion is closely spaced to other portions of the image. The control system and/or each marking engine can be connected to a data source 162 over a signal line or link. The data source provides data to be output by the marking engines. The data source can include, for example, a scanner, digital copier, digital camera, facsimile device that is suitable for generating electronic image data, or a device suitable for storing and/or transmitting the electronic image data, such as a client or server of a network, or the internet, and especially the worldwide web. The data source may also be a data carrier such as a magnetic storage disk, CD ROM, or the like, that contains data to be output by marking. The link connecting the image data source to the control system/marking engines can include, for example, a direct cable connection, public switched telephone network, wireless transmission channel, connection over a wide area network or a local area network, intranet or internet connection, or a connection over any other distributed processing network or system.

The control system may signal the user when the job or jobs requiring the custom color are completed. The user then replaces the custom module in the original principal module, increasing the productivity of the printing system for normal printing.

Figure 5:
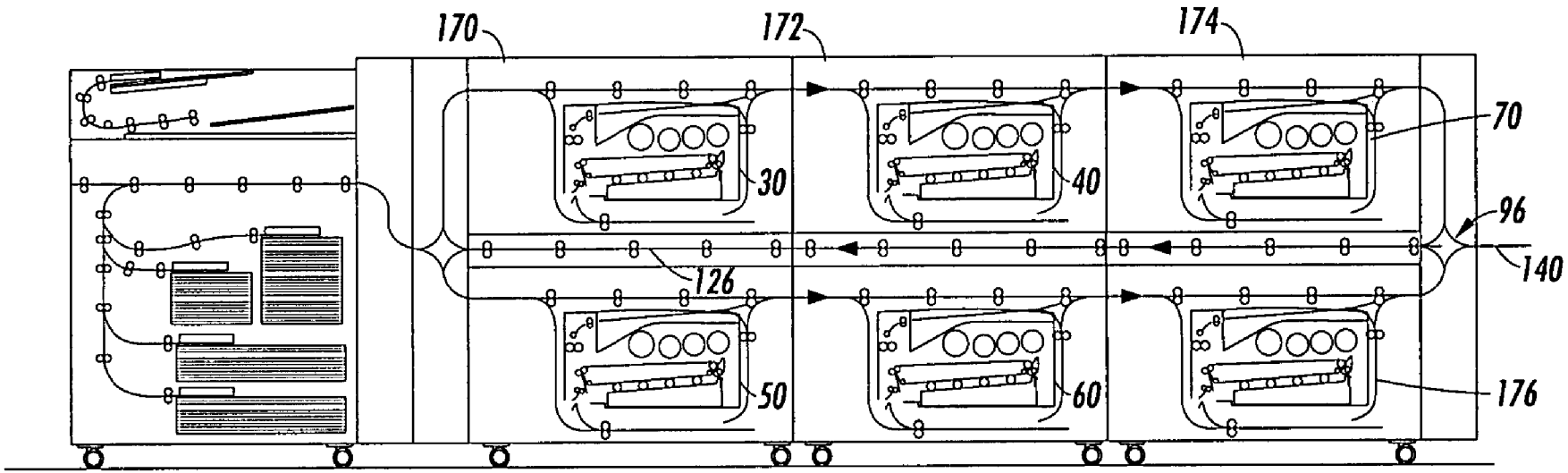
FIG. 5 is a schematic view of a printing system according to another embodiment.

In place of removing an existing principal module with the custom module it is also contemplated that the user may add a custom module to the system. For example, as illustrated in FIG. 5, where similar elements are accorded the same numerals and different elements, new numerals, a modular system comprises a first tower 170 which includes a first pair of principal modules 30, 50 and a second tower 172 which includes a second pair of principal modules 40, 60. When custom color printing is desired, an additional tower 174 comprising one or more custom modules 70, 176 is added to the system between tower 172 and the cloverleaf pathway 96. The tower 174 can be removed when no longer required.

In the illustrated embodiments, multiple marking engines can be tightly coupled to or integrated with one another in a variety of combinations thereby enabling high speed printing and low run costs, with a high level of up time and system redundancy.

The architecture, described above, enables the use of multiple marking engines within the same system and can provide simplex and duplex printing as well as multi-pass printing. In single pass duplexing, one side of a sheet is printed on one marking engine, while the second side is printed on a second marking engine. In conventional duplex printing, the sheet is recirculated back to the first engine for printing the second side. In multi-pass printing, one side of a sheet is printed on one marking engine, and the same side is printed on another marking engine. A single sheet of paper may be marked by two or more of the printers or marked a plurality of times by the same printer, before reaching the finisher. For custom color multi-pass printing, two custom modules may be incorporated into the printing system.

The scheduling system 154 may determine that a particular job is best performed (e.g., in terms of print quality, efficiency or both) by a particular subset of the marking modules and direct the paper accordingly. In the event that one of the marking modules is not performing satisfactorily or requires maintenance, the scheduling system or control system 150 redirects the print jobs originally scheduled to go to that printer module to one or more other printer modules. Thus, the print job may be able to continue (provided other printer modules provide the desired printing capabilities) albeit at a lower throughput or lower quality output. Printing need not be interrupted for a module replacement, since the paper path network remains substantially intact.

The printing system 36 can be reconfigured at any time to suit the particular print jobs to be handled. For example, a user may have a particular print job which requires a custom color not provided by any of the modules 30, 40, 50, 60 currently in the system. The user switches one of the existing modules for a module having the specialized capabilities and the printing system handles the job. This can be achieved without stopping the printing system by scheduling the changeover for a period of time when the remaining module (s) can handle the requirements of the jobs being printed at the time. When the job with the specialized capability is complete, the specialized module is removed from the system.

The modular architecture enables a wide range of marking engines to be selectively employed in the same system. The marking engines can involve a variety of types and processing speeds. The modular architecture can provide redundancy for marking engines and paths. The modular architecture can utilize as little as a single media source on the input side, a single printer module and a single finisher on the output side. It is to be appreciated that an advantage of the system is that it can achieve very high productivity, using marking processes in elements that do not have to run at high speeds and marking/finishing processes that can continue to run while other marking engines are being serviced or replaced. Although not shown, other examples of the modular architecture can include an odd number of marking engines. For example, three marking engines can be configured such that two are aligned vertically and two are aligned horizontally, wherein one of the marking engines is common to both the vertical and horizontal alignment.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A xerographic printing system comprising:

a group of marking modules which apply a marking medium to print media, at least one of the marking modules being a custom marking module;

a control system configured for being operatively linked with selected ones of the marking modules for controlling printing of images by the linked marking modules from a common print job stream;

the printing system having:

a first mode of operation in which a first plurality of the group of marking modules is operatively linked to the control system and to a common output destination; and a second mode of operation in which a second plurality of the marking modules, comprising at least one different marking module from the first plurality of marking modules, is operatively linked to the control system and linked to the common output destination, the second plurality of marking modules including the at least one custom marking module.

2. The printing system of claim 1, further comprising a support structure which supports at least a plurality of the marking modules.

3. The printing system of claim 2, wherein the support structure supports fewer than all of the marking modules whereby in the first mode of operation, the support structure supports the first plurality of marking modules and in the second mode of operation, the support structure supports the second plurality of marking modules.

4. The printing system of claim 1, wherein at least one custom marking module is interchangeable with at least one of the other marking modules such that in the first mode of operation, the custom marking module is not operatively linked to the control system and in the second mode of operation, the custom marking module is operatively linked to the control system.

5. The printing system of claim 1, wherein the first plurality of marking modules comprises fewer than all the marking modules and the second plurality of marking modules comprises fewer than all of the marking modules.

6. The printing system of claim 1, wherein at least one of the marking modules in the first plurality of marking modules is also in the second plurality of marking modules.

7. The printing system of claim 1, further comprising at least one print media feeder which feeds print media to the marking modules that are operatively connected with the control system.

8. The printing system of claim 1, wherein the at least one common output destination receives print media from the marking modules that are operatively connected with the control system and is configured for combining print media outputs from two or more of the marking modules into a single document.

9. The printing system of claim 8, further comprising at least one print media network which selectively conveys print media between each of the marking modules that are operatively connected with the control system and the output destination.

10. The printing system of claim 1, wherein the custom module includes at least one of:

a custom color marking module which prints print media with a custom color;

a magnetic ink character recognition marking module which applies a magnetic marking medium to print media; and an overcoat module which applies an overcoat to print media which has been applied by one of the other marking modules.

11. The printing system of claim 1, wherein the marking modules include at least one of:

a process color marking module; and a black marking module.

12. The printing system of claim 1, wherein each of the marking modules includes a fuser for fusing marking media applied by the marking module to the print media.

13. The printing system of claim 1, wherein each of the marking modules includes a charge retentive surface, an exposure station which forms a latent image on the charge retentive surface, a developer for developing the latent image formed on the charge retentive surface with the marking media, and a transferring unit, which transfers the developed image to the print media.

14. The printing system of claim 1, wherein the control system recognizes which of the marking modules are operatively connected to it.

15. The printing system of claim 1, wherein the control system includes a scheduling system which schedules print jobs, the scheduling system scheduling a job which includes printing print media with the custom marking module in the second mode of operation.

16. The printing system of claim 1, wherein the control system includes a paper path controller which controls the movement of print media through the printing system.

17. A xerographic printing method comprising:

in a first print job, printing print media with a printing system comprising a plurality of marking modules which are operatively connected for printing from a common job stream;

adding a custom marking module to the printing system such that the custom marking module is operatively connected to at least one of the plurality of marking modules for printing from a common job stream; and in a second print job, printing print media with the printing system comprising the custom marking module.

18. The method of claim 17, wherein the adding of the custom marking module includes replacing one of the plurality of marking modules with the custom marking module.

* * * * *